US005577982A

United States Patent [19]

Wells et al.

[11] Patent Number: 5,577,982

[45] Date of Patent: Nov. 26, 1996

[54] METHOD OF PERFORMING INCREMENTAL CONTROLLED MUSCULAR MOVEMENTS OF THE HEAD AND NECK MUSCLES FOR THE RESTORATION OF LOSS OF FUNCTION

[76] Inventors: David D. Wells; Virginia M. Wells, both of 1061 NW. 78 Ave., Plantation, Fla. 33322

[21] Appl. No.: 535,591

[22] Filed: Oct. 3, 1995

[51] Int. Cl.[6] ..... A63B 23/025

[52] U.S. Cl. ..... 482/10; 482/131; 601/39

[58] Field of Search ..... 482/10, 95, 131, 482/907; 606/240; 601/39; 5/636, 640

[56] References Cited

U.S. PATENT DOCUMENTS

| | | | |
|---|---|---|---|
| 2,791,999 | 5/1957 | Bustamante . | |
| 3,605,144 | 9/1971 | Hayte | 482/10 |
| 4,221,074 | 9/1980 | Gonzalez . | |
| 4,339,124 | 7/1982 | Vogler . | |
| 4,367,870 | 1/1983 | Birch | 5/636 |
| 4,537,393 | 8/1985 | Kusch . | |
| 4,583,731 | 4/1986 | Crivello et al. | 482/138 |
| 4,645,198 | 2/1987 | Levenston | 482/10 |
| 4,760,842 | 8/1988 | Holmes | 606/240 |
| 4,838,249 | 6/1989 | Jannotta | 606/240 |
| 5,306,232 | 4/1994 | Whitmyer . | |
| 5,336,139 | 8/1994 | Miller . | |
| 5,336,498 | 8/1994 | Snider | 5/636 |

FOREIGN PATENT DOCUMENTS

| | | | |
|---|---|---|---|
| 1347606 | 11/1963 | France | 606/240 |
| 225934 | 1/1968 | Germany | 5/636 |

OTHER PUBLICATIONS

Richard Dominguez, M.D. and Robert Gajda, "Total Body Training" 1982.

"Special Populations" catalogue by Flaghouse, pp. 172 and 176 Mar. 1995.

Marjorie Craig, "Miss Craig's Face-Saving Exercises", 1970, pp. 78 and 79.

One page (p. 8) of Patent No. 2,644,690 from unknown country.

*Primary Examiner*—Linda C. Dvorak
*Assistant Examiner*—Jeanne M. Clark
*Attorney, Agent, or Firm*—Richard C. Litman

[57] ABSTRACT

Assistance in the restoring of genetic loss of function is achieved by a method providing incremental controlled movements of the head and neck muscles and wherein the body assumes the supine, prone and left and right lateral positions, all in a horizontally aligned disposition while atop a plane surface. Head/neck lift movements are executed in an exercise series involving successive movements in a vertical and left to right direction, initially terminating with a rest pause following each head/neck lift. Following a sequence of a plurality of levels, the full muscular range of motion is obtained, in an incremental manner, through the use of a firm support element inserted beneath the upper back in certain of the levels involving the supine position, beneath the chest in certain of the levels involving the prone position and beneath the head in certain of the levels involving the left and right lateral positions. By altering the thickness dimension of these support elements, an incremental change of muscular range of motion is accomplished. A final level is carried out with omission of the rest pause following each repetition of head/neck lift movements and by modifying an upper leg position in each lateral body position while in the prone and supine positions, raising the upper body upon the elbows prior to performing the same series of head/neck movement. Supplemental shoulder girdle muscle movements are also performed in a quadruped position.

5 Claims, 2 Drawing Sheets

METHOD OF PERFORMING INCREMENTAL CONTROLLED MUSCULAR MOVEMENTS OF THE HEAD AND NECK MUSCLES FOR THE RESTORATION OF LOSS OF FUNCTION

BACKGROUND OF THE INVENTION

1. Field of the Invention

This invention relates generally to a method of assisting in the restoring of the genetic loss of function to the head, neck and shoulder girdle area of the human body and more particularly, to an improved method of providing relief from the subjective sensation of discomfort and/or pain resulting from the genetic loss of function within these stated areas.

2. Description of the Prior Art

It is well recognized that numerous body ailments and discomforts are attributable to mal-conditioned muscles in the head/neck and shoulder girdle area. Swollen, taut or strained muscles in these areas are known culprits frequently blamed for neck and shoulder pains and even headaches, not to mention other ailments. With over 30 specific muscles ringing the neck's seven vertebrae it is little wonder that with such a convolution of parts, any abnormality may cause pain in the head, neck, shoulder or back and this pain can be in the form of stabbing pain, radiating pain, dull aching pain or a numbness or loss of sensation. The causes of pain in these areas are numerous and can be traced to occupational requirements such as sitting all day with one's head tilted to view a computer monitor or, house painting to mention a few. Likewise, various avocations can lead to pain in the subject areas. A most common type of pain attributable to spasm and trigger points in the neck are cervical headaches.

It is acknowledged that specific exercise or body movements may be employed to alleviate pain experienced in the head, neck and shoulder regions whereupon muscular dysfunction is rectified. Various appliances have been proposed for the purpose of assisting in carrying out an exercise regimen.

An example of a neck exercising appliance will be found in U.S. Pat. No. 2,791,999 issued May 14, 1957 to Bustamante. In this prior teaching, a frame device is affixed to the body with contact portions engaging the shoulders, chin and nape of the neck following which the user manipulates side mounted elements to vertically stretch the neck. This is unlike the current invention wherein no appliance is attached to the user's body and the sole manipulation of the concerned muscles is obtained by carrying out prescribed body movements while changing the orientation of the body and incrementally altering the muscular range of motion.

U.S. Pat. No. 4,221,074 issued Sep. 9, 1980 to Gonzalez depicts an apparatus that is primarily an amusement device but shows that it is known to provide a body attached appliance used in association with movements of the body. Such a device requires proper coordination of one's hips, arms or head to achieve rotation of hoops disposed at the distal portions of the device unlike the present invention wherein precise upper body movements are carried out without the attachment of a foreign device to the body.

A device specifically intended to allow for the exercise of one's neck will be found in U.S. Pat. No. 4,339,124 issued to Vogler on Jul. 13, 1982 and again, involves an appliance affixed to the body. In this instance, the user dons a helmet constructed to permit the attachment of selected bar bell weight discs following which the head is rotated in one direction and then, in the opposite direction. This is in contrast to the instant method wherein no disparate device is attached to the body but wherein a series of different levels of head and neck movements are carried out in a prescribed manner to progressively bring into play different muscles of the head, neck and shoulder girdle.

Still another example of an appliance intended to allow exercise of the neck muscles is shown in U.S. Pat. No. 4,537,393 issued to Kusch on Aug. 27, 1985 and wherein a head harness including springs is anchored to a wall bracket. This is unlike the present invention wherein no foreign device is affixed to the user's body and wherein exercise of the concerned muscles is achieved through the unincumbered positioning of the body while a plurality of prescribed body movements are carried out with the body being disposed in alternate positions.

U.S. Pat. No. 5,306,232 issued Apr. 26, 1994 to Whitmyer discloses an additional head engaging device adapted to be affixed to a suitable stationary member and serves to maintain a user's head in a substantially upright position, rather than to permit exercise of the wearer's muscles. This is unlike the instant proposal wherein no foreign device is attached to the user's body and dysfunctional head, neck and shoulder girdle muscles are exercised through a precise regimen of body movements in a specific series of varying levels.

A further example of an exercise system particularly aimed at one's neck muscles is presented in U.S. Pat. No. 5,336,139 issued to Miller on Aug. 3, 1994 and wherein a harness engaging the user's waist, shoulders and head includes elastic straps providing resistance during head movements. Applicants' method, on the other hand, avoids any body attached appliance and relies upon precise body movements in a prescribed sequence while changing the orientation of the body and altering the range of muscular motion involved.

None of the above inventions and patents, taken either singly or in any combination, is seen to even remotely suggest or describe the instant invention as claimed herein.

SUMMARY OF THE INVENTION

By the present invention an improved method is offered whereby pain and genetic loss of function in one's head, neck and shoulder girdle region is relieved or assisted in restoration through an exercise regimen devoid of body attached appliances. Pressure and strain in the soft tissues of these body regions is relieved by carrying out a prescribed series of multi-level exercises requiring but a flat surface such as the floor or a bed. The head and neck muscles are initially treated by performing a series of five levels of exercises, each while the body is disposed in one of four horizontal positions comprising supine, left lateral, prone and right lateral positions. The plurality of levels present a progressive or incremental degree of increased effort or work-out with respect to the affected muscles and this is accomplished, not by cables, pulleys or the like but rather, through the use of variously dimensioned support members placed under the head while in the two lateral positions and while in the prone and supine positions, under the upper chest and back, respectively. Obtaining maximal shoulder girdle function is further achieved by performing a series of four alternate body movements while disposed in a quadruped position, each carried out for at least ten repetitions and during which, the head may be moved, turned, lifted or rotated in any direction, thereby combining the exercise of the shoulder girdle muscles together with those of the head and neck.

Accordingly, one of the objects of the present invention is to provide an improved method of assisting in restoring genetic loss of function to the head, neck and shoulder girdle muscles including performing a series of multi-level exercises each incrementally calling for increased muscular range of motion as defined by the degree of head and neck displacement as the body remains horizontally aligned.

Another object of the present invention is to provide an improved method of assisting the restoring of genetic loss of function to the head, neck and shoulder girdle muscles including performing a series of progressive levels of exercises each carried out while the body is horizontally aligned atop a flat surface and is successively turned to supine, left lateral, prone and right lateral positions.

A further object of the present invention is to provide an improved method of assisting the restoring of genetic loss of function to the head, neck and shoulder girdle muscles including performing a multi-level series of head and neck exercises while the body is horizontally disposed in four alternate orientations followed by movement to a quadruped position and the performance of four distinct body exercises.

Another object of the present invention is to provide an improved method of assisting the restoring of genetic loss of function to the head, neck and shoulder girdle muscles including performing a series of head, neck and shoulder girdle exercises in a plurality of horizontally aligned positions while angularly oriented in each of four positions followed by a final series of four positions wherein in right and left lateral positions the upper leg is bent and its ankle grasped, while in prone and supine positions the torso is disposed at a 30 degree angle while resting upon the elbows and during this final series, a plurality of head and neck exercises are carried out.

Still another object of the present invention is to provide an improved method of assisting the restoring of genetic loss of function to the head, neck and shoulder girdle muscles including performing a series of multi-level exercises involving movement of the head and neck in incremental fashion while reposing the body in horizontal alignment in each of four alternate basic orientations with the various increments being controlled by the use of a support element disposed intermediate the body and a flat underlying surface.

These and other objects of the present invention will become readily apparent upon further review of the following specification and appended claims.

BRIEF DESCRIPTION OF THE DRAWINGS

FIGS. 9 and 10 are front views illustrating the first of a series of four movements to specifically treat the shoulder girdle muscles while in a quadruped position on both knees and hands.

FIGS. 11 and 12 are top views of the second movement of the quadruped position series.

FIGS. 13 and 14 are left side and right side views, respectively, of the third movement of the quadruped position series.

FIG. 15 is a left side view of the fourth movement of the quadruped position series.

Similar reference characters designate corresponding parts throughout the several figures of the drawings.

DETAILED DESCRIPTION OF THE PREFERRED EMBODIMENT

Figure 1:
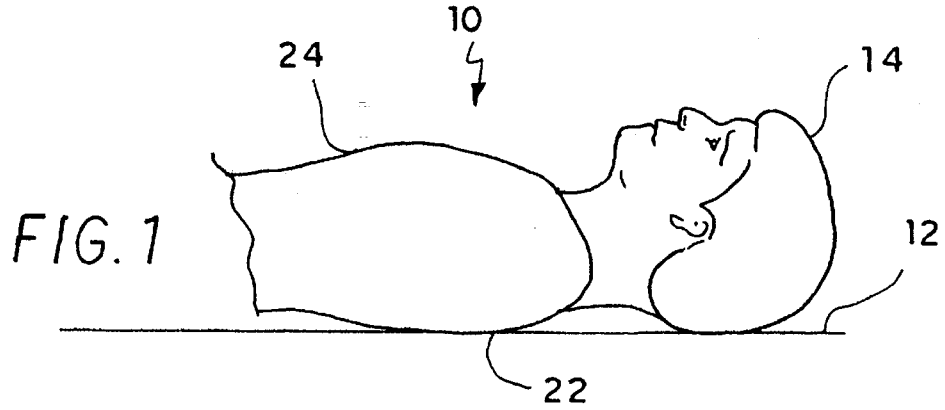
FIGS. 1–4 are left side views illustrating the starting position of four of the five levels of a first series of head/neck movements as conducted when in a supine position and FIGS. 5–8 are front views illustrating the starting position of four of the five levels of a first series of head/neck movements as conducted when in a left lateral position.
Figure 2:
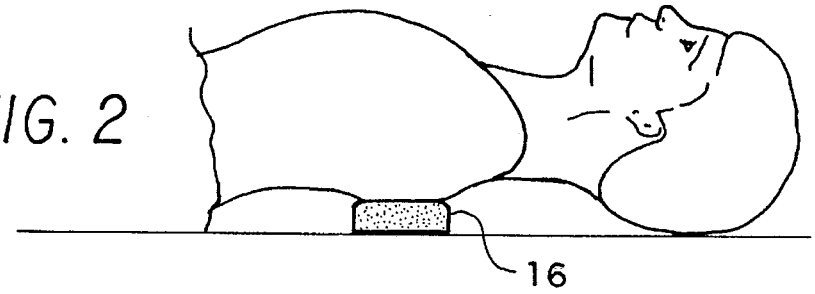
Figure 3:
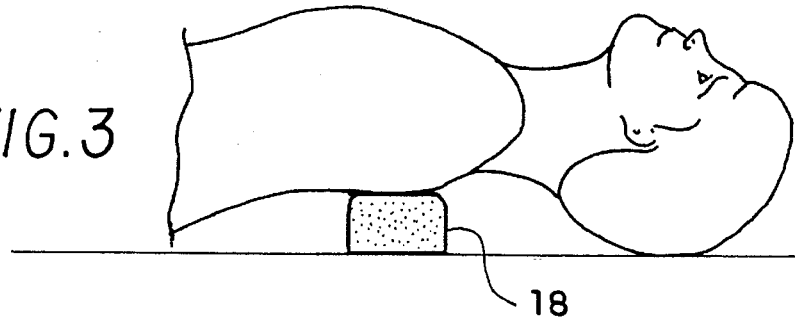
Figure 4:
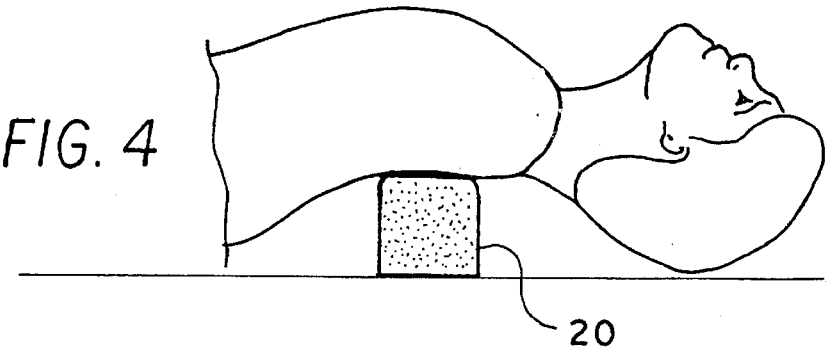

To obtain the full range of movement while exercising the soft tissues associated with the head, neck and shoulder girdle requires two considerations. First, the body must be disposed in a plurality of alternate positions in order to bring into play the maximum number of the affected muscles and secondly, the degree of body movement while in each of the plurality of body positions is to be approached in an incremental manner. With this in mind it will follow that no single muscle will be overworked while others are neglected and also, the chances of producing added stress or strain upon any of the muscles is minimized. Unlike prior procedures as discussed hereinabove, the present method achieves the desired results without the attachment to the body of a foreign appliance employing pulleys, cables or elastic components. The objects of this invention are obtained through a prescribed series of body movements in each of a plurality of basic positions selected to affect particular muscles such that when one has progressed through all of the series, the maximum number of muscles will have been manipulated. The incremental nature of the invention is obtained by carrying out the entire series of exercises through five distinct levels of exercises wherein the muscular range of motion is varied between these levels.

The series of exercises will be understood to be carried out upon a firm horizontal surface such as the floor or a bed (without a pillow) and involves a first or basic group of four positions all of which call for the body to be disposed in a straight, horizontal alignment. These basic positions comprise the supine, left lateral, prone and right lateral positions. FIGS. 1–4 represent the body, generally designated 10, as it will be disposed in the supine position, resting atop a horizontal plane surface 12 such as the floor or a bed. The disposition of the entire body in this position will be obvious and need not be shown in the drawings, it being apparent that at least the head 14, buttocks and legs are all supported from below by the plane surface 12 while variously dimensioned firm support elements 16,18,20 will be positioned between the upper back 22 and the plane surface 12 while undertaking the to be described exercises in the levels represented by FIGS. 2–4.

Before describing the exercise regimen for the various levels, the other basic positions of the initial series of positions will be related. FIGS. 5–8 represent the body 10 when disposed in the second basic, or left lateral position. It will be understood that the balance of the straightened body 10 is supported upon the firm plane surface 12, from the shoulder to the foot while variously diminsioned support elements 20,18,16 are to be positioned intermediate the head 14 and plane surface during the levels shown in FIGS. 5–7. During the initial level-I phase of the method when in this second basic position, a firm three-inch support element 20 is positioned beneath the head 14 so as to define a rest position wherein the head lifts will manipulate the affected muscles a lesser degree than if the muscles were called upon to carry out the lifts from a position supported directly upon the plane surface 12.

The remaining two basic positions will be apparent from a review of FIGS. 1–4 and 5–8 respectively, as they comprise merely a reverse or 180 degree disposition of the body position. In a third basic position, the body 10 is disposed prone upon the stationary horizontal plane surface 12. Thus, with the body 10 reversed from that as shown in FIGS. 1–4, the head 14 will be facing downwardly with one's chest 24 and obviously the hips and legs resting atop the plane surface 12. The same support elements 16,18,20 will come into play in the various additional levels of this prone position as will become apparent hereinafter.

In the fourth basic position, the body 10 is turned 180 degrees from that as shown in FIGS. 5–8, to assume a right lateral basic position wherein the right side of the head is above the plane surface 12. Again, the same support elements 20,18,16 will be used in combination with the various levels in this series of exercises.

The various levels of exercises performed while in all the basic positions are calculated so that while the body is disposed in the horizontal or modified horizontal neck/cervical positions, the head and neck muscles lift the head vertically within the full functional range of these muscles. During these exercises, the seven vertebrae of the neck and particularly the eleventh cranial nerve are manipulated, together with the longus colli, longus capitis, anterior, middle and posterior scalenus muscles. It is by the varied angular working of these muscles and the incremental extension and contraction thereof, that the entire functional range of the involved soft tissues is brought into play.

Figure 5:
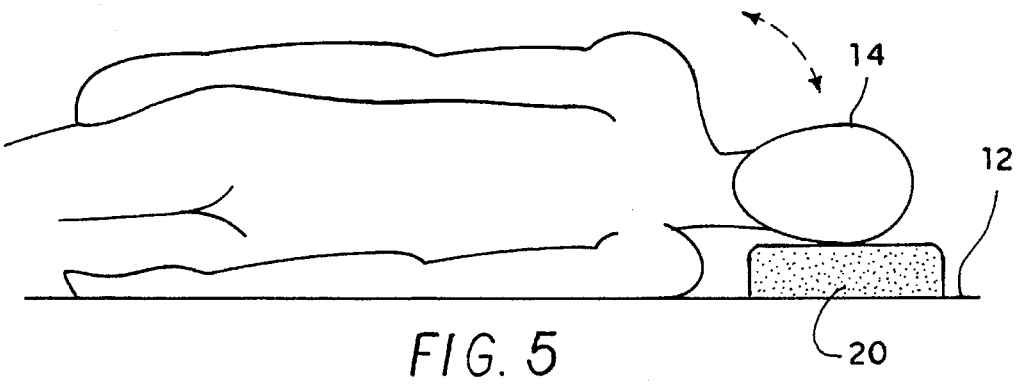

Starting with the body positioned as in FIG. 1, the series of exercises will be described, it being understood that in each of the four basic body positions and throughout all of the plurality of levels thereof, the head 14 begins and ends each repetition from one of three positions: (1) turned to the left, (2) straight ahead or vertically and (3) turned to the right. While the head is disposed in each of these three positions, it is lifted away from the plane surface 12 (or head support element if applicable) and then returned to its lowered position. Each such movement is repeated five times with a rest state following each such movement. Alternatively, the head may be moved right or left in a repetitive manner while in the resting position or during the head lifts. Following the above repetitive head lifts with the head in all three specified positions, the left lateral position is assumed by the body, as shown in FIG. 5 and the same five repetitions of head lifts are carried out with the head in each of the three positions, again with the rest state between each head lift. A distinction in this lateral position of the level-I procedure is that a three-inch thick support element 20 is located between the head and plane surface 12. With this arrangement, the plurality of head lifts are carried out without as much manipulation of the muscles being required while the head is lifted an amount less than if the starting or rest position were the plane surface 12. Thereafter, the body is placed in the third basic or prone position (not shown) and the same three sets of repetitive head lifts accomplished, with the rest state following each head lift. Obviously, in this body position, the three head positions comprise: (1) facing downwardly, (2) turned to the right and (3) turned to the left. The fourth series of exercises is as above described with respect to the second basic position except that the body is disposed on its right side.

The four basic positions having been described, together with the attendant three head positions associated with each, the other levels of this exercise series will now be related. As previously mentioned, there are five levels of exercises necessary to fulfill the present regimen. The series described above comprise a level-I phase of the method while the muscles are incrementally manipulated a greater degree during the succeeding four additional levels II,III,IV and V. Levels II,III and IV all follow the same four basic positions and five repetitive head lifts in the three head positions, including the rest phases, as described above but alter the forces involved during the muscle manipulations by varying the angle of the cervical vertebrae during the respective levels of exercise. More specifically, level-II, while in the supine basic position calls for the use of a one-inch thick support element 16 between the upper back 22 and the plane surface 12. The dimension of the support element is changed to a two-inch thick support element 18 during level-III and a three inch support element 20 during the level-IV phase of exercises in this position. Final phase level-V of this series will be described following an outline of the balance of levels-II through IV when in the other three basic positions.

Figure 6:
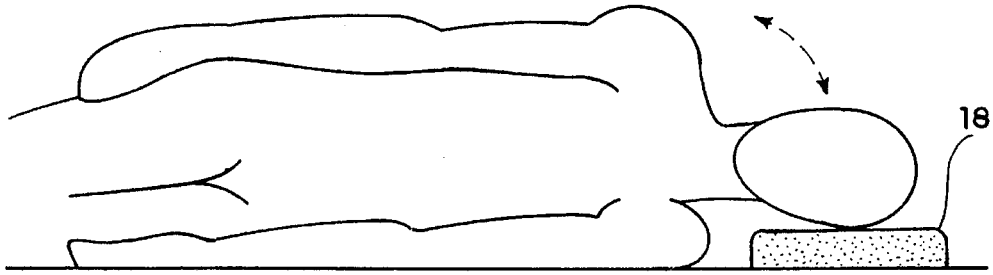
Figure 7:
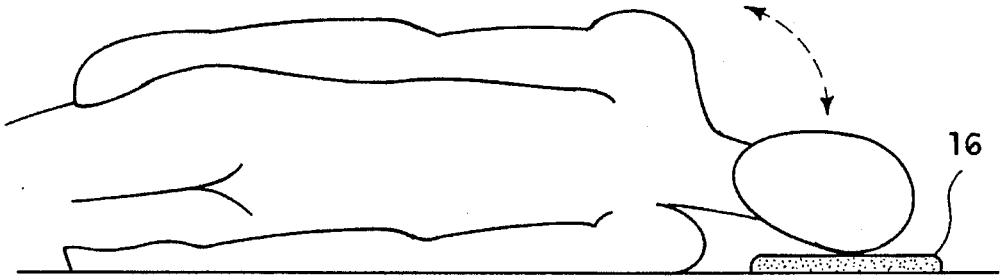
Figure 8:
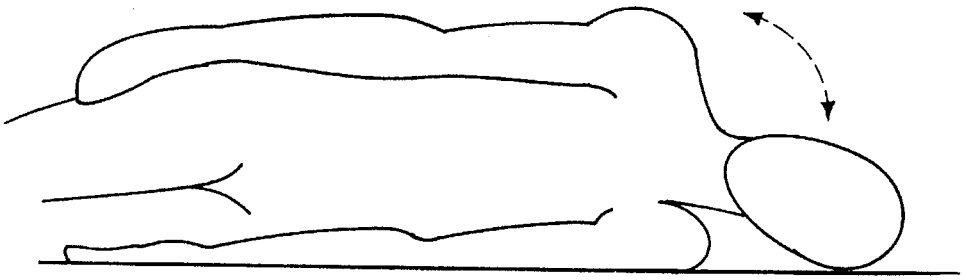

In the level-II phase when in the left lateral position as shown in FIG. 6, a two-inch thick support element 18 is substituted for the three-inch support element as used during the level-I phase, prior to carrying out the five repetitions of the above related exercises, while in all three head positions. Thereafter, the prone position is assumed and for level-II, a one-inch thick support element 16 is placed beneath the chest 24, followed by the described repetitions of the head lifts in all three head positions. Level-II continues by assuming the right lateral position, with the same support element 18 and regimen as described with respect to the left lateral position in this level.

Level-III and level-IV are carried out with the same body positions as described above, together with the identical head lifts. However, for the level-III phase, a two-inch thick support element 18 is used beneath the back 22 while in the supine position and beneath the chest 24 while in the prone position. This support element is changed to a three-inch thick support element 20 for the level-IV phase, during the supine and prone positions. Also, for the two lateral positions, level-III exercises are performed while the one-inch thick support element 16 is employed, while the level-IV movements in this position omit any support element.

Level-V phase is next entered and wherein the degree of effort changes as the muscular range of motion of each head/neck lift is increased to its maximum level. Two distinctions will become apparent during the level-V phase. Firstly, during the same head/neck lifts, the head is raised as high as possible and allowed to fall back as far as possible, without assuming a resting position intermediate the repetitions. Secondly, each of the four basic positions are modified by alternative body positions to bring into play further manipulations of the concerned soft tissues. In the supine position, one begins in a sitting position and leans back until resting upon the elbows/forearms so as to place the back at an angle of approximately 30 degrees (not shown). The same described head/neck lifts are begun with the head as far back as possible.

In the case of the level-V movements while in the two lateral positions, the leg is bent at the knee while the hand grasps the ankle of that leg, whereafter the same head/neck lifts are accomplished.

During the level-V exercises while in the prone position, the upper torso is elevated while resting upon the elbows with the forearms extended and palms facing downwardly such that the chest is at an angle of approximately 30 degrees (not shown), whereupon the same head/neck lifts are carried out.

Upon completion of all levels while disposed in the various positions, one migrates to body movements intended to specifically further treat the shoulder girdle muscle. Maximum shoulder girdle function is achieved by performing this series of exercises while in a quadruped position on both knees and both hands, with the palms flat. A series of four movements are prescribed. The first movement shown in FIGS. 9 and 10 comprises alternately bending and straightening one elbow and then the other, allowing one-half of the shoulder girdle to drop or fall downwardly with the bending of each elbow for ten repetitions each side. The second movement from the above starting position movement shown in FIGS. 11 and 12 comprises raising and lowering the torso, upper chest and head, akin to performing modified push-ups, but without bending the elbows, for ten repetitions. For the third movement shown in FIGS. 13 and 14, alternately bend each elbow and while allowing the shoulder adjacent the bent elbow to drop, the shoulder girdle and arm are rotated in a circular movement, similar to pedaling a bicycle. In this manner, when one shoulder is up, the other is down and when one is forward, the other is back. Ten repetitions are called for. The final movement shown in FIG. 15 comprises leaning upon the forearms with palms down and lowering the body until the forehead is resting upon the plane surface 12. The head is rolled from side to side while simultaneously dropping the shoulder being faced. Ten repetitions for each side are performed. During any or all of these shoulder girdle muscle movements, the head may be moved, turned, lifted or rotated in any direction.

It will be understood that the present invention is not limited to the sole embodiment described hereinabove, but encompasses any and all embodiments within the scope of the appended claims.

We claim:

1. A method of treating the loss of function of the head and neck muscles including multiple graduated levels of a series of exercises comprising:

supplying a planar surface;

supplying a plurality of firm support elements, each element with a different thickness;

for each graduated level of exercise, performing a first series of head and neck lifts while the patient is in the supine position on the planar surface and controlling the degree of movement of the head and neck lifts by inserting a firm support element of the desired thickness under the patient's shoulder area if necessary;

performing a second series of head and neck lifts while the patient is on their left side in a lateral position on the planar surface and controlling the degree of movement of the head and neck lifts by inserting a firm support element of the desired thickness under the patient's head if necessary;

performing a third series of head and neck lifts while the patient is in the prone position on the planar surface and controlling the degree of movement of the head and neck lifts by inserting a firm support element of the desired thickness under the patient's shoulder area if necessary;

performing a fourth series of head and neck lifts while the patient is on their right side in a lateral position on the planar surface and controlling the degree of movement of the head and neck lifts by inserting a firm support element of the desired thickness under the patient's head if necessary;

repeating the above sequence of exercises for each level of increasing difficulty wherein after completion of each level the patient's head and neck muscles have been incrementally exercised; and wherein a beginning level of exercise for the supine and prone positions does not use any support elements and for the right and left lateral position uses the thickest of the support elements, and the increasing levels of difficulty for the supine and prone positions uses increasingly thicker support elements while for the right and left lateral positions uses decreasingly thicker support elements.

2. The method according to claim 1 wherein, each series of head and neck lifts includes:

a first set of lifting the head while the head is facing straight out over the torso and positioned centrally over shoulders;

a second set of lifting the head while the head is turned to the right side; and a third set of lifting the head while the head is turned to the left side.

3. The method according to claim 1 including, conducting a resting pause following each said head and neck lift.

4. The method according to claim 3 including, moving the head from side to side while in said resting pause.

5. The method according to claim 3 including, rotating the head from side to side while in said resting pause.

* * * * *